US008276640B2

(12) United States Patent
Fukazawa et al.

(10) Patent No.: US 8,276,640 B2
(45) Date of Patent: Oct. 2, 2012

(54) CARTRIDGE TYPE COATING FILM TRANSFER TOOL

(75) Inventors: Keiichi Fukazawa, Tokyo (JP); Kenji Kobayashi, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 92 days.

(21) Appl. No.: 12/661,145

(22) Filed: Mar. 11, 2010

(65) Prior Publication Data

US 2010/0252204 A1 Oct. 7, 2010

(30) Foreign Application Priority Data

Apr. 6, 2009 (JP) ..... 2009-091949

(51) Int. Cl.

| | |
|---|---|
| ***B29C 65/52*** | (2006.01) |
| ***B29C 65/56*** | (2006.01) |
| ***B32B 37/10*** | (2006.01) |
| ***B32B 37/14*** | (2006.01) |
| ***B32B 41/02*** | (2006.01) |
| ***B65C 9/40*** | (2006.01) |
| ***B65C 9/42*** | (2006.01) |
| *B32B 37/26* | (2006.01) |
| *B32B 38/10* | (2006.01) |
| *B32B 38/14* | (2006.01) |
| *B65H 26/08* | (2006.01) |
| *G05G 15/06* | (2006.01) |
| *G05G 15/08* | (2006.01) |

(52) U.S. Cl. ..... 156/577; 156/538; 156/579; 156/495; 156/446; 156/361

(58) Field of Classification Search ..... 156/577, 156/361, 446, 495, 538, 579
See application file for complete search history.

(56) References Cited

U.S. PATENT DOCUMENTS

| | | | | |
|---|---|---|---|---|
| 6,521,045 | B1 * | 2/2003 | Koyama et al. | 118/257 |
| 6,730,186 | B2 * | 5/2004 | Takahashi | 156/238 |
| 2002/0170684 | A1 * | 11/2002 | Tamai et al. | 156/577 |
| 2003/0037886 | A1 * | 2/2003 | Kobayashi | 156/577 |
| 2005/0082010 | A1 * | 4/2005 | Nishioka et al. | 156/540 |
| 2005/0139326 | A1 * | 6/2005 | Mitsui et al. | 156/540 |

* cited by examiner

*Primary Examiner* — Sonya Mazumdar
(74) *Attorney, Agent, or Firm* — Edwards Wildman Palmer LLP; Scott D. Wofsy

(57) ABSTRACT

Provided is a cartridge type coating film transfer tool, in which a cartridge can be simply dismounted and is readily exchanged. A case body comprises a slide member on an upper wall of an upper case. A tapered portion provided on the slide member is extended downward beyond a lower cartridge case of a tape cartridge in a height direction. When the slide member is slid toward a leading end side, a trailing end of the tape cartridge is lifted up until it abuts against a step portion in a state of riding over a tapered portion of the slide member. Thereby, it is possible to release engagement between engagement pawls and engagement holes, which are used in mounting the case body and the tape cartridge to each other.

7 Claims, 6 Drawing Sheets

CARTRIDGE TYPE COATING FILM TRANSFER TOOL

BACKGROUND OF THE INVENTION

1. Field of the Invention

The present invention relates to a cartridge type coating film transfer tool, and more particular, to a cartridge type coating film transfer tool, in which a cartridge can be simply dismounted and is readily exchanged.

2. Description of the Related Art

Conventionally, coating film transfer tools are widely made use of with a view to correction of letters and coating of an adhesive. Among the coating film transfer tools, there exists a cartridge type one, in which a correction tape and an adhesive tape as used are formed as a cartridge to enable exchange and a construction of which is disclosed in JP-A-2005-34994, etc.

With such cartridge type coating film transfer tool, a member arranged at a trailing end of the coating film transfer tool to slide engages with a cartridge whereby the cartridge does not come off a body when the cartridge is mounted. Therefore, when the cartridge is to be exchanged, the member as sliding is pulled toward the trailing end side to once release engagement between the both members and after the cartridge is exchanged, the slide member is again slid toward a leading end side whereby the both members are caused to engage with each other. Accordingly, such cartridge type coating film transfer tool requires many manipulations for exchange of a cartridge and exchange is complex.

SUMMARY OF THE INVENTION

The invention has been thought of in order to solve the problem described above and has its object to provide a cartridge type coating film transfer tool, in which a cartridge can be exchanged in a simple manipulation.

According to a first aspect a cartridge type coating film transfer tool comprises a case body, and a tape cartridge including a cartridge case, a supply reel, which is received in the cartridge case and around which a coating film transfer tape is wound, a winding reel, to which the coating film transfer tape is wound, and a transfer head, on which the coating film transfer tape is stretched, the tape cartridge being detachably mounted to the case body, and wherein one of the case body and the tape cartridge includes an elastic portion capable of elastic deformation and an engagement projection projecting from a surface of the elastic portion, the other of the case body and the tape cartridge includes an engagement hole for engagement with the engagement projection, a slide member is provided on the case body, and the slide member is slid whereby the tape cartridge is moved relative to the case body, so that the engagement projection and the engagement hole are released from engagement.

According to the invention, it is possible in a simple manipulation to dismount and exchange a tape cartridge.

According to a second aspect the cartridge type coating film transfer tool according to the first aspect is described, wherein the slide member includes a tapered surface and/or a rounded, convex surface, and when the slide member is slid, the tapered surface and/or the rounded, convex surface enters below and abuts against an abutting portion formed on the tape cartridge to lift up the tape cartridge whereby the engagement projection and the engagement hole are released from engagement. Thereby, it is possible to form the slide member in a simple structure.

According to a third aspect the cartridge type coating film transfer tool according to the second aspect is described, wherein the case body and the tape cartridge are provided at least at ends toward the transfer head with the engagement projection and the engagement hole, and the abutting portion is provided close to an end of the tape cartridge on an opposite side to the transfer head. Thereby, the tape cartridge can be readily dismounted by rotating movements thereof.

According to a fourth aspect describes the cartridge type coating film transfer tool according to the second or third aspect is described, wherein a peripheral wall of the tape body and a peripheral wall of the cartridge case, respectively, include abutting surfaces facing each other to enable preventing the tape cartridge from moving toward the transfer head, and the abutting surfaces are shaped not to obstruct movements of the tape cartridge when the slide member lifts up the tape cartridge. Thereby, the tape cartridge is made further liable to rotationally move.

According to a fifth aspect the cartridge type coating film transfer tool according to any one of the first to fourth aspect is described, wherein the slide member is biased toward an opposite side to the transfer head by an elastic body. Thereby, it is unnecessary to manually move the slide member toward an opposite side to the transfer head.

According to a sixth aspect the cartridge type coating film transfer tool according to any of the first to fifth aspect is described, wherein at least a portion of the slide member projects from an outer surface of the case body. Thereby, the slide member is improved in visibility and operability.

According to a seventh aspect the cartridge type coating film transfer tool according to any of the first to sixth aspect is described, wherein the engagement projection comprises an inclined surface, which contacts with the other of the inner surfaces to cause elastic deformation of the elastic portion when the tape cartridge is to be mounted to the case body, and an engagement surface, which contacts with the other of the engagement holes to cause elastic deformation of the elastic portion when the tape cartridge is to be dismounted from the case body, and an angle formed by a tangent to the engagement surface and the surface of the elastic portion is larger than 90 degrees. According to the invention, the tape cartridge is readily dismounted.

According to an eighth aspect the cartridge type coating film transfer tool according to the seventh aspect is described, wherein the engagement surface comprises an inclined surface and/or a curved surface. Thereby, the tape cartridge is further readily dismounted.

According to the invention, it is possible to very readily perform the work for exchange of a tape cartridge.

DESCRIPTION OF THE PREFERRED EMBODIMENTS

Figure 1:
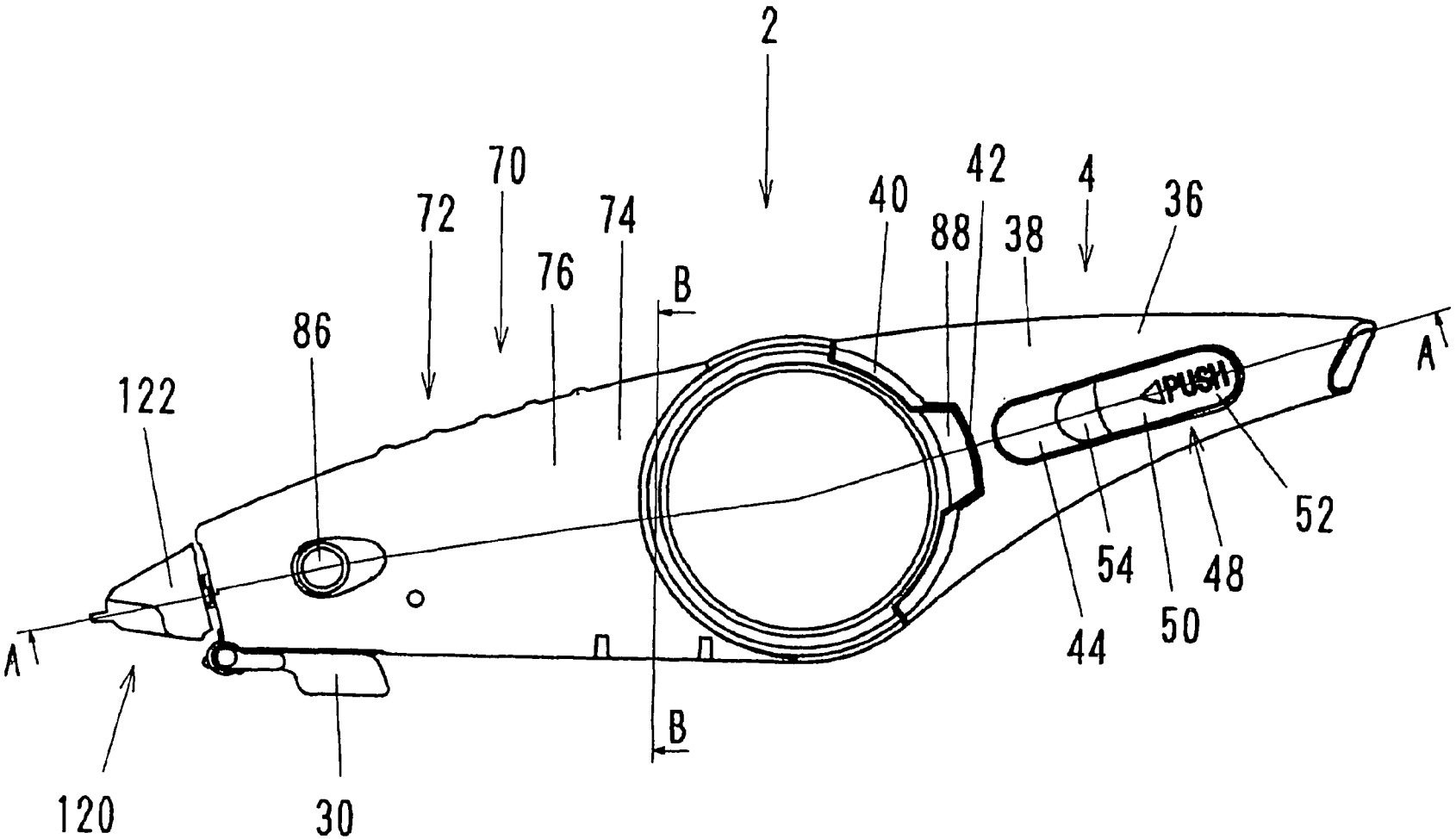
FIG. 1 is a front view showing a coating film transfer tool 2 according to an embodiment of the invention.
Figure 2:
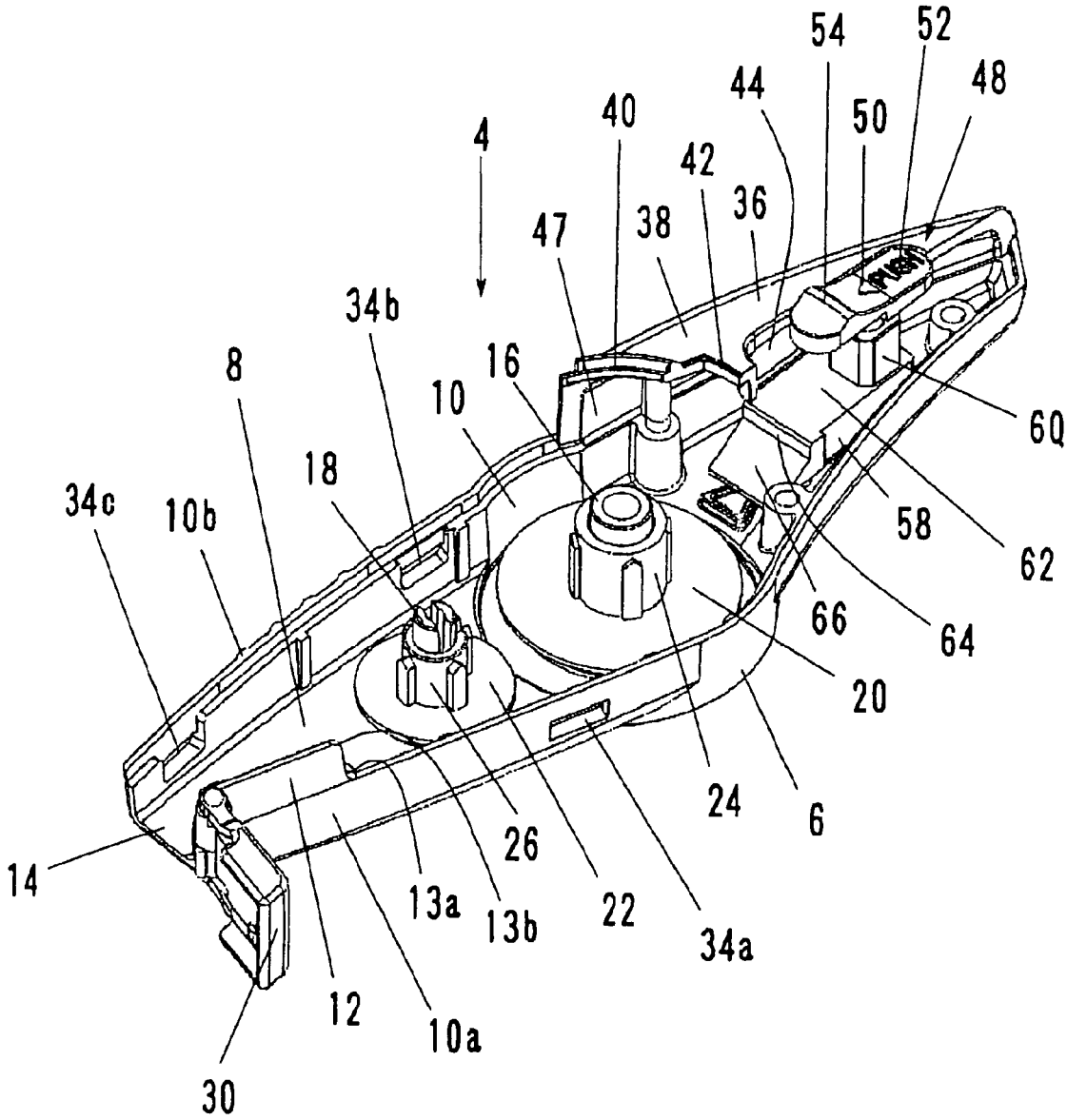
FIG. 2 is a perspective view showing a case body 4.
Figure 3:
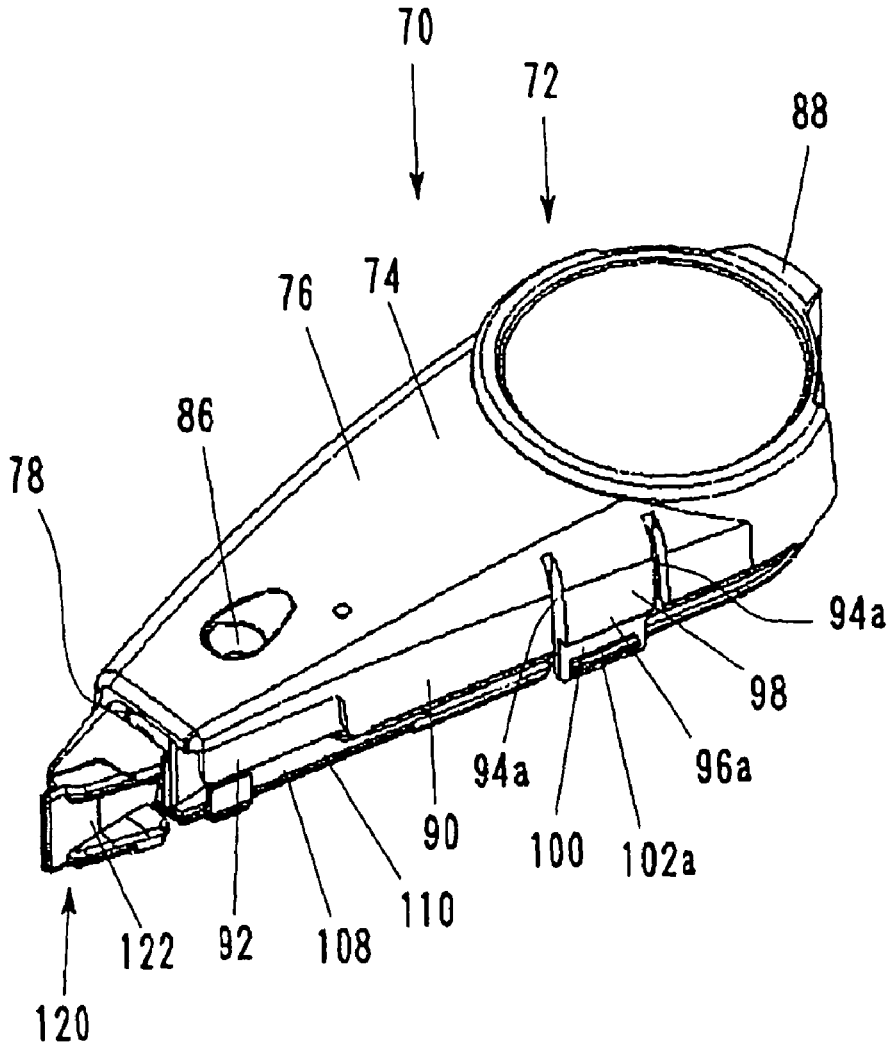
FIG. 3 is a perspective view showing a tape cartridge 70.
Figure 4:
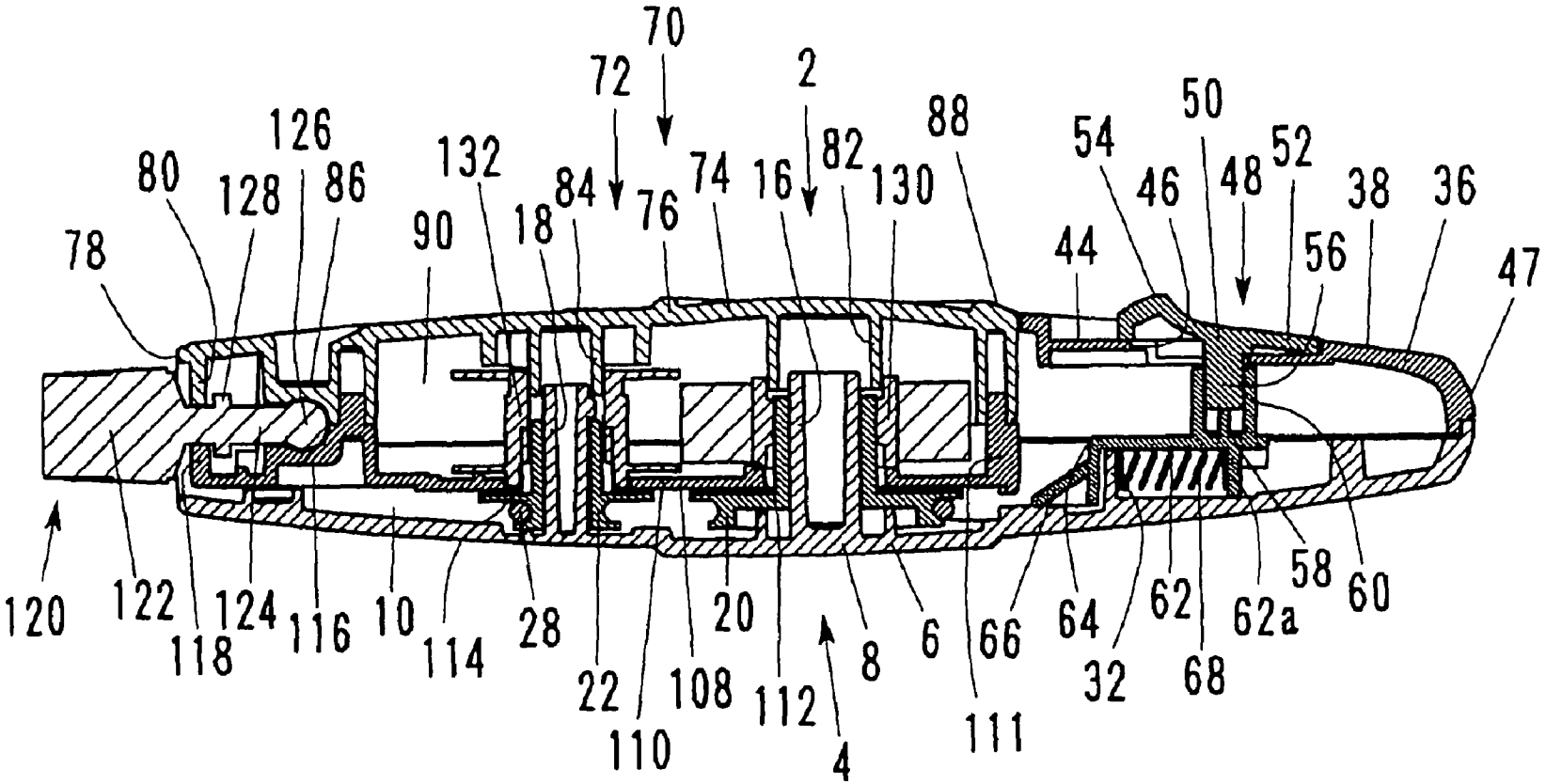
FIG. 4 is a cross sectional view taken along the line A-A in FIG. 1.

An embodiment of the invention will be described below with reference to the drawings. FIG. 1 is a front view showing a cartridge type coating film transfer tool 2 (referred simply below to as "coating film transfer tool") according to an embodiment of the invention, FIG. 2 is a perspective view showing a case body 4, FIG. 3 is a perspective view showing a tape cartridge 70, and FIG. 4 is a cross sectional view taken along the line A-A in FIG. 1. FIG. 2 shows the case body 4 with a part (upper case 36) on a trailing end side being cut out. As shown in FIG. 1, the coating film transfer tool 2 substantially comprises the case body 4 and the tape cartridge 70. In addition, unless otherwise specified, "leading end side" indicates a side of the coating film transfer tool 2 toward a transfer head 120 and "trailing end side" indicates an opposite side to the side described above.

First, the case body 4 will be described with reference to FIGS. 1, 2, and 4. The case body 4 comprises a lower case 6 and an upper case 36. The lower case 6 comprises a bottom wall 8, the bottom wall 8 being shaped to be wide at a substantially central portion thereof and narrow toward both sides therefrom as shown in FIG. 2. Further, a peripheral wall 10 having substantially the same height along an outer periphery of the bottom wall 8 except a leading end thereof is provided upright on the lower case 6 to be put in an upwardly opened state. Since the peripheral wall 10 is not provided upright at the leading end of the bottom wall 8, an opening 14 having a substantially U-shaped cross section is defined in this region by a leading end edge of the bottom wall 8 and a leading end edge of the peripheral wall 10. Also, an extension 12 having a constant width and extending upward from the end edge, which defines the opening 14, is provided on one 10*a* of opposed, leading end sides 10*a*, 10*b* of the peripheral wall 10.

A supply spindle 16 extending substantially vertically toward an interior of the case body 4 is formed integrally and substantially centrally of the bottom wall 8 of the lower case 6 and a winding spindle 18 is formed integrally toward the leading end relative to the supply spindle 16. The reference numerals 20, 22 denote pulleys provided with hollow shaft portions 24, 26, which are fitted onto the supply spindle 16 and the winding spindle 18, to rotate interlockingly through a rubber belt 28, which is circular in cross section as shown in FIG. 4. A turnable head cover 30 is journaled on outer surfaces of the extension 12 and its continuous portion on the one 10*a* of the leading end sides of the peripheral wall 10, the turnable head cover being turned clockwise in FIG. 1 whereby the transfer head 120 of the tape cartridge 70 can be protected. The construction is well-known and a detailed explanation thereof is omitted. A spring bearing part 32 in the form of a substantially vertical plate having a predetermined length is provided substantially toward the leading end relative to the center on an inner surface side of the bottom wall 8 in a manner to cross a length direction of the bottom wall 8 (see FIG. 4), the spring bearing part being described later.

Referring to FIG. 2, the peripheral wall 10 is provided with laterally long engagement holes 34*a*, 34*b*, 34*c*, into which engagement pawls 102*a*, 102*b*, 102*c* of the tape cartridge 70 are fitted. Specifically, the engagement holes 34*a*, 34*b*, 34*c*, are provided in two locations to face each other in positions slightly offset toward the leading end side from positions corresponding to the supply spindle 16 and in one location on the leading end side 10*b* of the peripheral wall 10. In addition, like the engagement pawls 102*a*, 102*b*, 102*c*, the engagement holes 34*a*, 34*b*, 34*c* are not limited to the number but can be provided in an optional number.

The upper case 36 comprises an upper wall 38 and a peripheral wall 47 along an outer periphery thereof to cover the lower case 6 over a right portion thereof substantially relative to the center thereof. As shown in FIG. 2, the upper wall 38 is cut out on a leading end side thereof so as to have the tape cartridge 70 mounted thereto and shaped on the peripheral wall 47 to comprise arcuate portions 40 cut out arcuately about the supply spindle 16 of the lower cartridge 6 and a recess 42 cut out in a trapezoidal shape between the arcuate portions 40.

The upper wall 38 is further formed with a groove 44, which extends longitudinally of the coating film transfer tool 2 and is arcuate-shaped at both ends thereof to have the same diameter. A hole 46 is formed over a predetermined extent centrally of the groove 44, and a slide member 48 is mounted to the groove 44 and the hole 46. The slide member 48 comprises a knob 50 and a knock body 58, the knob 50 being a member having a substantially T-shaped cross section to comprise an umbrella portion 52 and a shaft portion 56 as shown in FIG. 4, and a ridge 54 is formed on a leading end side of the umbrella portion 52 to protrude upward in FIG. 4. The knock body 58 comprises a cylindrical portion 60, into which the shaft portion 56 of the knob 50 is fitted, a box-shaped base portion 62 formed integrally at a lower end of the cylindrical portion 60 and opened on a lower side thereof, and a tapered portion 66 inclined downward at a predetermined angle from a leading end side wall of the base portion 62. The tapered portion 66 extending integrally from a position a little below an upper end of the leading end side wall of the base portion 62 whereby the tapered portion 66 and a step portion 64 in a boundary portion are formed on the base portion 62.

The slide member 48 is mounted to the upper case 36 by inserting the shaft portion 56 of the knob 50 into the hole 46 and fitting the shaft portion 56 into the cylindrical portion 60 of the knock body 58. At this time, the umbrella portion 52 of the knob 50 is longer than the hole 46 in a longitudinal direction, the umbrella portion 52 is fitted into the groove 44 to be put on a bottom thereof, and the slide member 48 is guided by the groove 44 to be able to slide in the longitudinal direction. As shown in FIG. 4, the base portion 62 receives inside thereof a spring bearing portion 32 formed on the bottom wall 8 of the lower case 6 and a compression spring 68 is provided between the spring bearing portion 32 and a trailing-end side inner wall 62*a* of the base portion 62. Therefore, the slide member 48 is normally put in a state of being biased toward a trailing end of the coating film transfer tool 2. In addition, the ridge 54 of the knob 50 is put in a state of protruding from an outer surface of the upper case 36 and serves as a finger hook when sliding should be accomplished.

Figure 5:
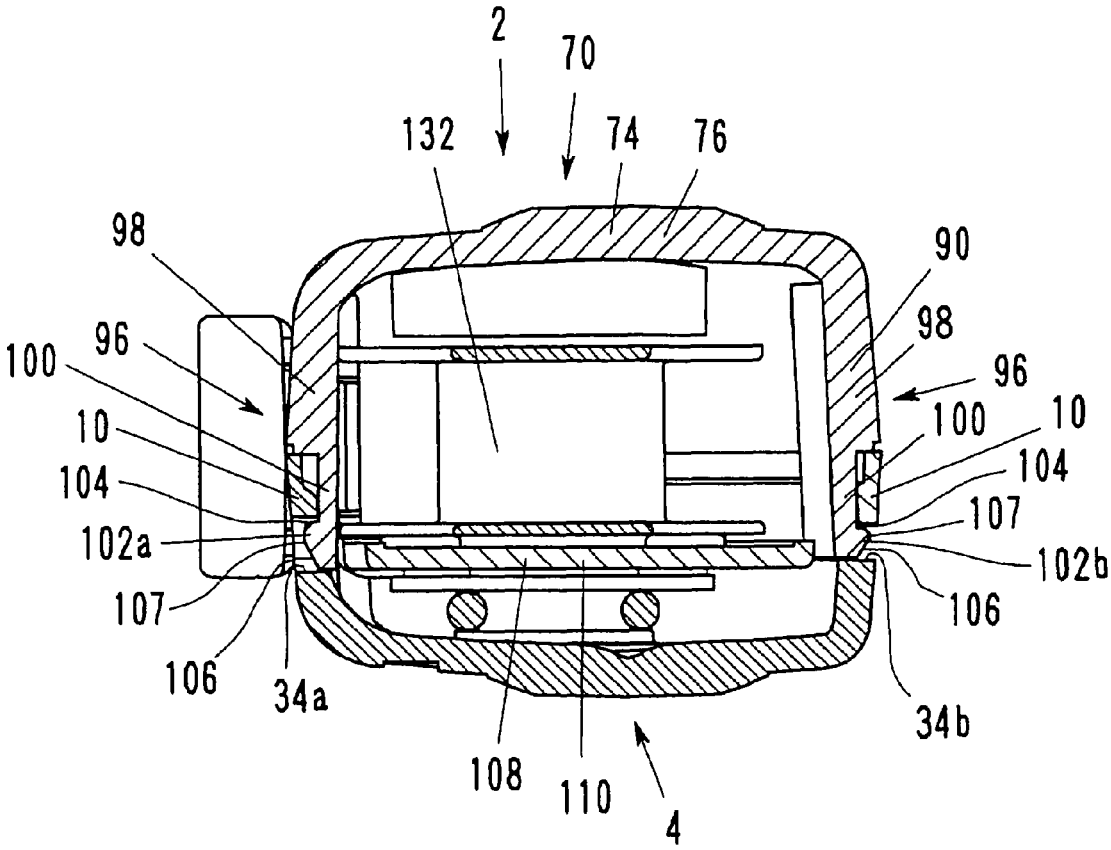
FIG. 5 is a view obtained by rotating a cross sectional view, which is taken along the line B-B in FIG. 1, clockwise by 90 degrees.

The tape cartridge 70 will be described below with reference to FIGS. 1, 3, 4, and 5. FIG. 5 is a view obtained by rotating a cross sectional view, which is taken along the line B-B in FIG. 1, clockwise by 90 degrees. The tape cartridge 70 comprises a cartridge case 72, which receives a supply reel 130 and a winding reel 132, and the transfer head 120. First, an explanation will be given to the cartridge case 72. The cartridge case 72 is shaped so that it can be fitted into that portion of the case body 4, in which the upper case 36 is not present, and comprises an upper cartridge case 74 and a lower cartridge case 108.

The upper cartridge case 74 comprises an upper wall 76 and a peripheral wall 90, except a portion thereof, suspending along an outer periphery of the upper wall 76. Referring to FIG. 4, a hollow supply-reel receiving cylinder 82 and a hollow winding-reel receiving cylinder 84 are provided on the upper wall 76 to be positioned corresponding to the supply spindle 16 and the winding spindle 18 of the case body 4, the supply reel 130 and the winding reel 132 being fitted rotatably into the cylinders 82, 84. Also, a head fixed portion 86 dented inward is provided centrally on a leading end side of the upper wall 76.

The peripheral wall 90 is provided to get clear of a leading end edge 78 of the upper wall 76 and the arcuate portions 40 of the upper case 36 of the case body 4. Instead, as shown in FIG. 4, a coming-off preventive wall 80 is provided upright in a slightly inwardly offset position on the leading end edge 78 to prevent the transfer head 120, described later, from coming off the tape cartridge 70. In order to receive the extension 12 of the lower case 6 of the case body 4, the peripheral wall 90 is slightly scraped on a leading end side outer surface thereof to form a thin wall portion 92 (see FIG. 3). The thin wall portion 92 is shaped to correspond to the extension 12 and when the tape cartridge 70 is to be exchanged, an edge of the thin wall portion 92 abuts against an edge of the extension 12 to guide the tape cartridge 70 in movement. Also, since the peripheral wall 90 is provided on an end edge of a projection 88 of the upper wall 76 corresponding to the recess 42 of the case body 4, positioning is facilitated when the tape cartridge 70 is to be mounted to the case body 4.

Slits 94*a*, 94*b*, 94*c*, respectively, are provided two by two on the peripheral wall 90 to be positioned corresponding to both respective ends of the engagement holes 34*a*, 34*b*, 34*c* of the lower case 6 of the case body 4 whereby elastic portions 96*a*, 96*b*, 96*c* being easy of elastic deformation are defined (however, the slits 94*b*, 94*c* and the elastic portions 96*b*, 96*c* are not shown). The elastic portions 96*a*, 96*b*, 96*c* comprise a wall portion 98 being a part of the peripheral wall 90 divided by the slits 94*a*, 94*b*, 94*c*, and a thin-walled suspending portion 100 extending to a position of a bottom wall 110 of the lower cartridge case 108, described later, from a leading end of the wall portion.

Referring to FIGS. 3 and 5, outwardly convex engagement pawls or engagement projections, both terms are used similarly 102*a*, 102*b*, 102*c* (however, the engagement pawl 102*c* is not shown) are provided at lower ends of the respective suspending portions 100, the engagement pawls 102*a*, 102*b*, 102*c* comprising an engagement surface 104 inclining outward as it goes downward, an inclined surface 106 inclining inward as it goes downward, and an apex portion 107 being a most protuberant portion out of the engagement pawl 102*a*, 102*b*, 102*c* and connecting between the engagement surface 104 and the inclined surface 106 as shown in FIG. 5. The engagement surface 104 is formed at a greater angle than 90 degrees to a surface of the suspending portion 100 in a manner to first extend straight and to extend arcuately as it approaches the apex portion 107. On the other hand, the inclined surfaces 106 extend downwardly inward from the apex portions 107 of the engagement pawls 102*a*, 102*b*, 102*c* in a straight manner. This will be described later. In addition, while the slits 94*a*, 94*b*, 94*c* in the embodiment are provided to form the elastic portions 96*a*, 96*b*, 96*c* as well as the wall portion 98, the suspending portion 100 may be extended from an edge of the peripheral wall 90 to form the elastic portions 96*a*, 96*b*, 96*c* instead of providing the wall portion 98. Also, the slits 94*a*, 94*b*, 94*c* are not limited to two in number but can be made one in number to define the wall portion 98. Further, the elastic portions 96*a*, 96*b*, 96*c* may comprise an elastic portion or portions having the different structure described above.

As shown in FIG. 5, the lower cartridge case 108 comprises the bottom wall 110 being slightly smaller in planar shape than the upper wall 76 of the upper cartridge case 74 and a side wall 111 provided upright in a position corresponding to the projection 88 of the upper wall 76. As shown in the figure, the bottom wall 110 is provided with a supply-reel hole 112 and a winding-reel hole 114, so that the supply spindle 16 and the winding spindle 18, which are provided on the lower case 6 of the case body 4, are inserted into the holes when the tape cartridge 70 is to be mounted. Provided on a leading end side of the bottom wall 110 is a head fixed portion 116 being a dent corresponding to the head fixed portion 86 of the upper cartridge case 74, and provided on a leading end side from the head fixed portion 116 is a coming-off preventive wall 118 corresponding to the coming-off preventive wall 80 of the upper cartridge case 74 with a predetermined clearance from the coming-off preventive wall 80. The reference numeral 120 denotes a transfer head comprising a pointed head portion 122 protruding outside from the cartridge case 72 and a shaft portion 124 (see FIG. 4) extending into the cartridge case 72 from the pointed head portion 122.

The upper cartridge case 74 and the lower cartridge case 108 are mounted in a state, in which a spherical-shaped fixed portion 126 provided at an end of the shaft portion 124 of the transfer head 120 is interposed by the head fixed portions 86, 116 as shown in FIG. 4. Also, the supply reel 130 and the winding reel 132 are arranged in a manner to be fitted outwardly onto the spring bearing portion 32 and the winding-reel receiving cylinder 84, the supply reel 130 and the winding reel 132 being received in the tape cartridge 70. In addition, a coming-off preventive flange 128 is provided on the shaft portion 124 to abut against the coming-off preventive wall 80 of the upper cartridge case 74 and the coming-off preventive wall 118 of the lower cartridge case 108 to prevent coming-off of the transfer head 120 (see FIG. 4).

Mounting of the tape cartridge 70 to the case body 4 will be described with reference to FIG. 5. The tape cartridge 70 is positioned and mounted so that the supply spindle 16 and the winding spindle 18 enter into the supply reel 130 and the winding reel 132. At this time, the suspending portions 100 of the tape cartridge 70 enter along an inside of the peripheral wall 10 of the case body 4 to bring the inclined surfaces 106 of the engagement pawl 102*a*, 102*b*, 102*c* into the inside of the peripheral wall, mounting is easily accomplished since the elastic portions 96*a*, 96*b*, 96*c* are elastically deformed inwardly of the coating film transfer tool 2. When the engagement pawls 102*a*, 102*b*, 102*c* enter into the engagement holes 34*a*, 34*b*, 34*c*, a lower end of the wall portion 98 and an upper end of the peripheral wall 10 of the case body 4 abut against each other to be positioned. At this time, outer surfaces of the tape cartridge 70 and the case body 4 are flush with each other.

Subsequently, an explanation will be given' to dismounting of the tape cartridge 70 from the case body 4. As described above, the engagement pawl 102*a*, 102*b*, 102*c* are put in a state of entering into the engagement holes 34*a*, 34*b*, 34*c* and the engagement surfaces 104 of the engagement pawl 102*a*, 102*b*, 102*c* come into contact with upper edges of the engagement holes 34*a*, 34*b*, 34*c* to be caught thereby, so that the tape cartridge 70 will not be dismounted naturally from the case body 4. On the other hand, as shown in FIG. 5, since the engagement surfaces 104 are formed at a greater angle than 90 degrees to the suspending portions 100, when the tape cartridge 70 is pulled vertically (upward in FIG. 5) relative to the case body 4 by hand with a certain magnitude of force, the engagement pawl 102*a*, 102*b*, 102*c* ride over an inner surface of the peripheral wall 10 along the engagement surfaces 104 to enable releasing engagement of the both members. Also, since the engagement surfaces 104 are rounded (arcuate), it is possible to have the engagement pawls 102*a*, 102*b*, 102*c* readily riding over an inner surface of the peripheral wall 10, thus enabling readily dismounting the tape cartridge 70 from the case body 4. In addition, unity may be secured in making the engagement surfaces 104 straight or arcuate in shape.

Figure 6:
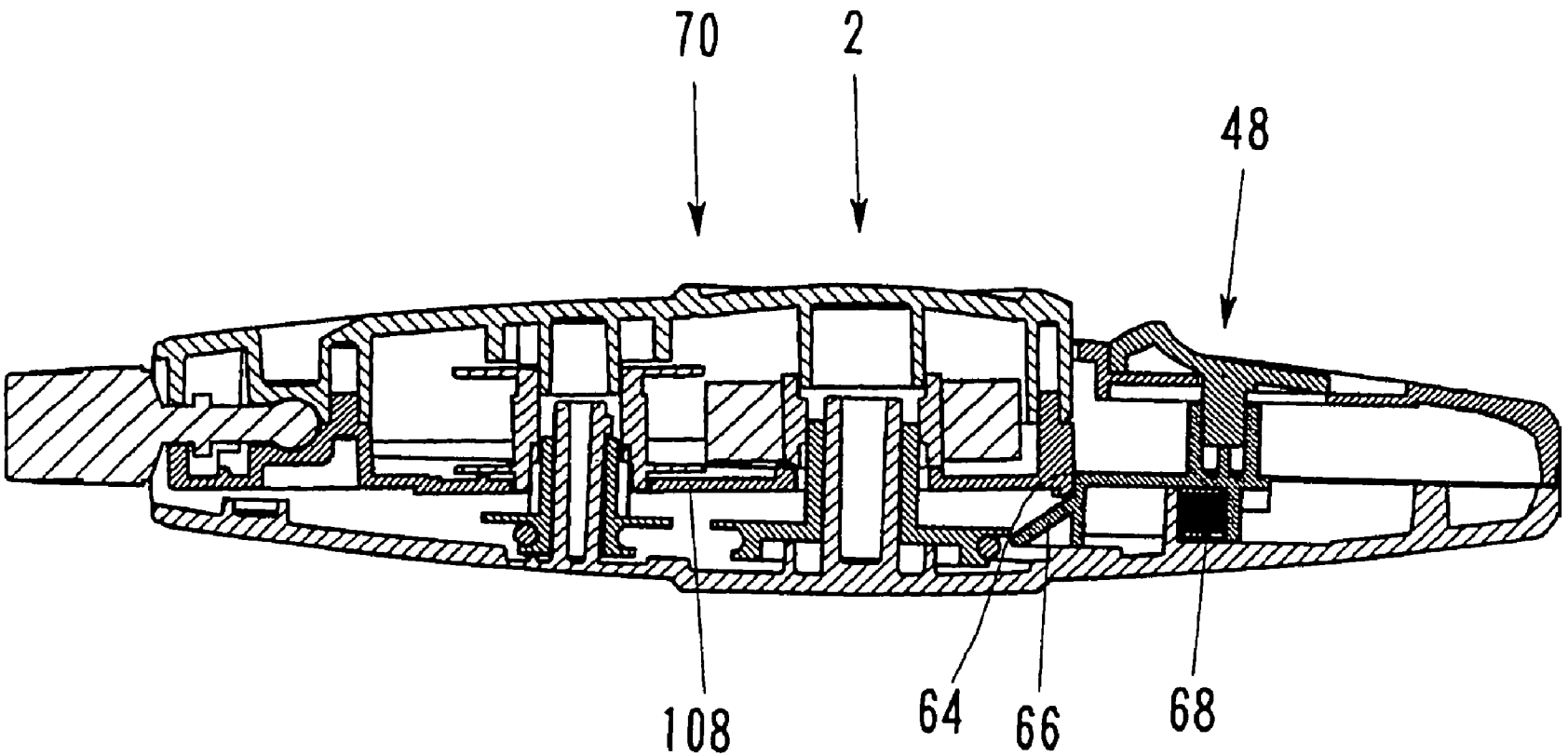
FIG. 6 is a cross sectional view taken along the line A-A to show a state, in which a slide member 48 is slid toward a leading end.

Subsequently, an explanation will be given to manipulation of the slide member 48 with reference to FIGS. 4 and 6. FIG. 6 is across sectional view taken along the line A-A to show a state, in which the slide member 48 is slid toward the leading end. As described above, the slide member 48 is normally biased by the action of the compression spring 68 toward the trailing end of the coating film transfer tool 2, in which state the tape cartridge 70 and the slide member 48 are not in contact with each other. As shown in FIG. 4, the tapered portion 66 of the slide member 48 is extended downward beyond the lower cartridge case 108 of the tape cartridge 70 in a height direction. When the slide member 48 is slid toward the leading end against the repulsive force of the compression spring 68, the trailing end of the tape cartridge 70 is lifted up until it abuts against the step portion 64 in a state of riding over the tapered portion 66 of the slide member 48, thus enabling releasing engagement between the two engagement pawls 102*a*, 102*b* of the tape cartridge 70 and the engagement holes 34*a*, 34*b*. Also, the engagement pawl 102*c* and the engagement hole 34*c* are put in a state of slightly engaging on the arcuate portion of the engagement surface 104 of the engagement pawl 102*c*, so that it is possible to more readily dismount the tape cartridge 70 than the case where the tape cartridge 70 is pulled directly by hand. In addition, while the through engagement holes 34*a*, 34*b*, 34*c* are provided in the embodiment, they suffice to engage with the engagement pawls 102*a*, 102*b*, 102*c* and so may be made blind holes. Also, an angle of inclination of the tapered portion 66 is preferably set to 45 degrees or less taking account of a wedge effect. Further, while the straight-shaped tapered portion is provided in the embodiment to lift up the tape cartridge 70, it may be a rounded, convex surface.

As shown in FIG. 2, the extension 12 of the case body 4 is rounded at corners 13*a*, 13*b* in contact with an edge of the thin wall portion 92 of the tape cartridge 70 and slightly inclined toward the leading end from the corner 13*a* to the angle 13*b* to act so as to have the tape cartridge 70 readily dismounting. That is, the tape cartridge 70 being lifted up by the slide member 48 moves rotationally (counter-clockwise in FIG. 6) with the engagement pawl 102*c* and the engagement hole 34*c* on the leading end side as a fulcrum. At this time, the corners 13*a*, 13*b* are rounded and a slope is provided toward the corner 13*b* from the corner 13*a* whereby the rotating movement is not obstructed by interference between an edge of the thin wall portion 92 and an edge of the extension 12 and so the tape cartridge 70 can smoothly move rotationally. In addition, also in the case where the tape cartridge 70 is directly dismounted by hand without the use of the slide member 48, the tape cartridge 70 can be readily dismounted by accomplishing a similar rotating movement with the engagement pawl 102*c* and the engagement hole 34*c* on the leading end side as a fulcrum.

What is claimed is:

1. A cartridge type coating film transfer tool (2) comprising:

a case body (4), and a tape cartridge (70) including a cartridge case (72), a supply reel (130), which is received in the cartridge case (72) and around which a coating film transfer tape is wound, a winding reel (132), to which the coating film transfer tape is wound, and a transfer head (120), on which the coating film transfer tape is stretched, the tape cartridge (70) being detachably mounted to the case body (4), and wherein one of the case body (4) and the tape cartridge (70) includes at least one elastic portion (96*a*) capable of elastic deformation and at least one engagement pawl (102*a*) projecting from a surface of the elastic portion (96*a*), the other of the case body (4) and the tape cartridge (70) includes at least one engagement hole (34*a*) for engagement with the engagement pawl (102*a*), a slide member (48) is provided on the case body (4), the slide member (48) is slid whereby the tape cartridge (70) is moved relative to the case body (4), so that the engagement pawl (102*a*,) and the engagement hole (34*a*) are released from engagement, the slide member (48) includes a tapered surface and/or a rounded, convex surface (66), and when the slide member (48) is slid, the tapered surface and/or the rounded, convex surface (66) enters below and abuts against an abutting portion formed on the tape cartridge (70) to lift up the tape cartridge (70) whereby the engagement pawl (102*a*) and the engagement hole (34*a*) are released from engagement.

2. The cartridge type coating film transfer tool (2) according to claim 1, wherein the case body (4) and the tape cartridge (70) are provided at least at ends toward the transfer head (120) with the engagement pawl (102*a*) and the engagement hole (34*a*), and the abutting portion is provided close to an end of the tape cartridge (70) on an opposite side to the transfer head (120).

3. The cartridge type coating film transfer tool (2) according to claim 1, wherein a peripheral wall (10) of the case body (4) and a peripheral wall (90) of the tape cartridge (70), respectively, include abutting portions facing each other to enable preventing the tape cartridge (70) from moving toward the transfer head (120), and the abutting portions (12) are shaped not to obstruct movements of the tape cartridge (70) when the slide member (48) lifts up the tape cartridge (70).

4. The cartridge type coating film transfer tool (2) according to claim 1, wherein the slide member (48) is biased toward an opposite side to the transfer head (120) by an elastic body.

5. The cartridge type coating film transfer tool (2) according to claim 1, wherein at least a portion of the slide member (48) projects from an outer surface of the case body (4).

6. The A cartridge type coating film transfer tool (2) comprising:

a case body (4), and a tape cartridge (70) including a cartridge case (72), a supply reel (130), which is received in the cartridge case (72) and around which a coating film transfer tape is wound, a winding reel (132), to which the coating film transfer tape is wound, and a transfer head (120), on which the coating film transfer tape is stretched, the tape cartridge (70) being detachably mounted to the case body (4), and wherein one of the case body (4) and the tape cartridge (70) includes at least one elastic portion (96*a*) capable of elastic deformation and at least one engagement pawl (120*a*) projecting from a surface of the elastic portion (96*a*), the other of the case body (4) and the tape cartridge (70) includes at least one engagement hole (34*a*) for engagement with the engagement pawl (102*a*), a slide member (48) is provided on the case body (4), the slide member (48) is slid whereby the tape cartridge (70) is moved relative to the case body (4), so that the engagement pawl (102*a*) and the engagement hole (34*a*) are released from engagement, wherein the engagement pawl (102*a*) comprises an inclined surface (106), which contacts with the other of the inner surfaces to cause elastic deformation of the elastic portion (96*a*) when the tape cartridge (70) is to be mounted to the case body (4), and an engagement surface (104), which contacts with the other of the engagement holes (34*a*) to cause elastic deformation of the elastic portion (96*a*) when the tape cartridge (70) is to be dismounted from the case body (4), and an angle formed by a tangent to the engagement surface (104) and the surface of the elastic portion (96*a*) is larger than 90 degrees.

7. The cartridge type coating film transfer tool (2) according to claim 6, wherein the engagement surface (104) comprises an inclined surface (106) and/or a curved surface.

* * * * *